United States Patent [19]

Buhler et al.

[11] Patent Number: 5,011,641

[45] Date of Patent: Apr. 30, 1991

[54] PREPARATION OF SHAPED AGGLOMERATED PARTICULATE MATERIAL

[75] Inventors: Marcel Buhler, Tolochenaz; Jean-Michel Martin, Valeyres/Rances, both of Switzerland

[73] Assignee: Nestec S.A., Vevey, Switzerland

[21] Appl. No.: 448,885

[22] Filed: Dec. 12, 1989

Related U.S. Application Data

[63] Continuation-in-part of Ser. No. 203,267, Jun. 7, 1988, Pat. No. 4,936,200.

[30] Foreign Application Priority Data

Jun. 25, 1987 [CH] Switzerland ..... 2392/87

[51] Int. Cl.[5] ..... B29C 43/06

[52] U.S. Cl. ..... 264/109; 264/297.7; 264/334

[58] Field of Search ..... 264/109, 119, 123, 334, 264/297.7

[56] References Cited

U.S. PATENT DOCUMENTS

| | | | |
|---|---|---|---|
| 810,193 | 1/1906 | Daum . | |
| 1,108,461 | 8/1914 | Michitsch . | |
| 1,706,874 | 3/1929 | De Journo . | |
| 2,177,607 | 10/1939 | Brown et al. . | |
| 3,257,685 | 6/1966 | Butow et al. | 425/261 |
| 3,381,632 | 5/1968 | Pontecorvo . | |
| 3,722,398 | 3/1973 | Freye et al. | 425/204 |
| 4,096,791 | 6/1978 | Weiss et al. . | |
| 4,241,649 | 12/1980 | Nelson et al. . | |
| 4,317,649 | 3/1982 | Boellmann . | |
| 4,348,166 | 9/1982 | Fowler . | |
| 4,528,900 | 7/1985 | Simelunas . | |
| 4,535,687 | 8/1985 | Antpöhler . | |
| 4,613,294 | 9/1986 | Rose et al. . | |
| 4,793,882 | 12/1988 | Brehmer et al. | 156/235 |

FOREIGN PATENT DOCUMENTS

| | | |
|---|---|---|
| 313674 | 2/1918 | Fed. Rep. of Germany . |
| 824174 | 12/1951 | Fed. Rep. of Germany . |
| 475406 | 5/1915 | France . |
| 993925 | 11/1951 | France . |
| 39949 | 12/1938 | Netherlands . |
| 1302188 | 1/1973 | United Kingdom . |

*Primary Examiner*—Mary L. Theisen

*Attorney, Agent, or Firm*—Vogt & O'Donnell

[57] ABSTRACT

Shaped articles of agglomerated particulate material are prepared by conveying plates having apertures therethrough on a surface for forming, by reason of the plate apertures and the forming surface, article shaping cells. Particulate material to be formed into the shaped articles is fed into the cells, and then while the plates remain on the forming surface, the particulate material in the cells first is tamped, and then while the plates ascend from the forming surface, the tamped material is ejected from the cells onto the forming surface in a form of shaped articles.

13 Claims, 5 Drawing Sheets

10
23
6
34
2
3

34

17

17
3

PREPARATION OF SHAPED AGGLOMERATED PARTICULATE MATERIAL

CROSS REFERENCE TO RELATED APPLICATIONS

This is a continuation-in-part application of Application Ser. No. 07/203,267, filed June 7, 1988 now U.S. Pat. No. 4,936,200.

BACKGROUND OF THE INVENTION

This invention relates to a process and apparatus for shaping individual articles of particulate materials.

Means, such as disclosed in U.S. Pat. No. 3,722,398, are known for moulding a granular tacky mass which comprises an endless shaping belt formed by juxtaposed plates each drilled with a row of holes into which the mass is introduced through a bottomless distributing box in contact with the plates of the shaping belt. The mass is kept in the holes by a surface on which the plates of the shaping belt slide and which, therefore, form cells for containing the mass. The mass then is compressed in the cells by a row of pistons. The articles thus moulded are ejected from the holes by other pistons downstream of the shaping surface and drop onto a transverse conveyor belt. Means of this type are suitable for the moulding and handling of relatively compact and solid articles which, in particular, can withstand a drop from the moulding belt onto the conveyor belt.

SUMMARY OF THE INVENTION

The present invention provides a process and apparatus which are suitable especially for moulding relatively fragile articles comprised of relatively light agglomerated particles, particularly particles agglomerated with a binder in a relatively loose, or airy, manner.

The process of the present invention is characterized by conveying at least one plate having apertures therethrough on a surface for forming, by reason of the plate apertures and the surface, article shaping cells, feeding particulate material to be shaped to the cells, tamping the material in the cells and then while maintaining the tamped material in contact with the forming surface, displacing the plates containing the tamped material away from the forming surface and ejecting the tamped material from the plate apertures onto the forming surface for depositing individual shaped articles from the apertures onto the forming surface.

More particularly, the present invention is carried out by a process characterized by conveying the plates containing the material in the cells to be shaped in synchronization with a means for tamping the material in the cells and for ejecting the tamped material from the plate apertures from a first upstream position to a first downstream position, while tamping the material in the cells, and then conveying the plates and the means for tamping and ejecting downstream from the first downstream position while maintaining the tamped material in contact with the forming surface and while ascending the plates for ejecting the tamped material from the plate apertures for depositing individual shaped articles on the forming surface and then disengaging the tamping and ejecting means from the plates and returning the tamping and ejecting means to the first upstream position.

The process of the present invention is carried out most advantageously by conveying the plates on a forming surface, preferably a substantially horizontal surface, which is conveyed in synchronization with the plates, and the means for tamping and ejecting advantageously comprises movable pistons. Thus, the present invention is characterized further by descending the pistons of a tamping and ejecting means into the plate apertures first for tamping the material in the cells and then for ejecting the material from the apertures while the plates ascend for depositing individual shaped articles on the forming surface, then disengaging the pistons and the tamping and ejecting means from the plates from which the shaped articles have been ejected, preferably by ascending the tamping and ejecting means from the plates, and then returning the tamping and ejecting means to the first upstream position. As described further below, the tamping and ejecting means is integral with a tamping and ejecting unit means.

As is evident readily, the pistons associated with the tamping and ejecting means should correspond in shape, number and arrangement with the shape, number and arrangement of the plate apertures, and the plates, the forming surface and tamping and ejecting means, when conveyed together in synchronization, should travel in the same direction at substantially the same speed.

Most preferably, the process of the present invention is carried out by conveying, in synchronization, an endless plurality of juxtaposed apertured plates and contacting a lower surface of a horizontal run of the plates with an upper surface of a horizontal run of an endless conveyor belt for forming the cells.

Most preferably, the cells are filled completely with material to be shaped, and thus, the invention is characterized further preferably by distributing and equalizing the particulate material fed to the cells by means which provide for assuring the filling of the cells with material to be shaped prior to tamping the material.

Additionally, the shaped articles deposited on the forming surface may be conveyed on the forming surface to a dryer for drying the articles.

To carry out the process the invention includes an apparatus preferably having conveyable juxtaposed apertured plates forming an endless shaping belt, an endless conveyor belt positioned beneath a part of the shaping belt, the conveyor belt having an upper run surface which comes into contact with a lower surface of the plates thereby forming, in combination with the apertures in the plates, article shaping cells, a conveyable tamping and ejecting means and means in combination for causing the tamping and ejecting means to descend into the apertures of the plates, first for tamping and then for ejecting shaped articles from the plate apertures and for causing the shaping plates to be displaced away from the forming surface while ejecting the shaped individual articles onto the forming surface of the conveyor belt and for enabling disengaging the tamping and ejecting means from the plates thereby enabling the articles to be removed from the cells without ever having left the forming surface of the belt.

It has been found that with the process and apparatus of the present invention it is possible to shape highly fragile articles, without disintegration, and particularly to shape articles agglomerated with a binder which are intended to be dried after shaping, even though the binding effect of the binder and the resistance of the articles to crushing or shearing of their particles are still very weak before drying. Thus, the present invention enables such articles to be shaped directly on a forming surface such as a conveyor belt and then be carried through a drying apparatus without the articles having to undergo impact or drop between shaping and drying.

DETAILED DESCRIPTION OF THE INVENTION

To carry out the process of the present invention, in a most preferred embodiment of the apparatus, a feed means and a tamping and ejecting means are provided above a flat lower part of a loop formed by an endless shaping belt having juxtaposed apertured plates. An endless conveyor belt is positioned beneath and aligned with the lower flat part of the shaping belt. The juxtaposed apertured plates are connected to drive chains by drive supports sliding on vertical drive shafts fixed to the chains. Vertical drive rollers are provided on transverse axles integral with the drive supports.

The tamping and ejecting unit means includes a vertical and horizontal-return drive mechanism and a vertical drive guide intended to cooperate with the vertical drive rollers. The tamping and ejecting means includes vertical pistons adapted to the apertures of an entire plate and is integral with a hood sliding on at least one vertically displaceable horizontal shaft, the hood additionally including a pivotal, horizontal-forward drive arm intended to cooperate with horizontal-forward drive fingers integral with the drive supports.

The endless shaping belt preferably forms an oval loop preferably having a lower flat part along which the apertured plates pass successively beneath the feed means, beneath an optional distributing and equalizing unit and then beneath and through the tamping and ejecting unit means. The apertured plates return to their starting position ahead of the feed means via a flat upper part of the oval loop. The forming surface of the endless conveyor belt positioned beneath the shaping belt preferably travels at the same speed and in the same direction as the shaping belt along the lower flat part of the loop and preferably extends beyond the downstream end of the lower flat part of the loop.

The apertured plates of the shaping belt may be made in various ways. For example, the apertures may have been drilled into a solid plate and may be cylindrical in shape. In that case, the pistons of the tamping and ejecting means adapted to the apertures are thus preferably also cylindrical in shape with a diameter slightly smaller than that of the apertures. In one preferred embodiment, the apertured plates are made in the form of grids of the grating type. This embodiment makes it possible to provide apertures separated by thin vertical walls and having openings of various shapes and sizes. However, the preferred shape is a square opening which enables individual cubic articles to be shaped. In that case, the pistons of the tamping and ejecting means adapted to the apertures preferably also have a square horizontal section with an edge length slightly smaller than that of the apertures.

The means for feeding the cells may be formed, for example, by an endless transverse conveyor belt which delivers a mass of particulate product to be formed into a hopper arranged above the shaping belt at the upstream end of the lower flat part of the loop.

The optional distributing and equalizing unit means may comprise, for example, at least one distributing island followed by rotary brushes and/or smoothing discs arranged over the entire width of the shaping belt plates above the latter and downstream of the feed means. The smoothing discs preferably are arranged in two rows, the downstream row comprising one disc less than the upstream row.

The apparatus is designed to be able to impart relative movements to the apertured plates and to the tamping and ejecting means so that the individual articles always remain on the conveyor belt forming surface throughout the tamping and ejecting operations.

Thus, most preferably in a first phase, when a plate reaches a certain position downstream of the optional distributing and equalizing unit means, the tamping and ejecting means, entrained in a horizontal forward movement from a first position by a finger of the tamping and ejecting unit means integral with the support of the plate, descends and compresses the particulate product in the cells by partial penetration of the pistons into the cells.

In a second phase, the plate ascends under the effect of the vertical drive rollers which engage with the vertical drive guide, which preferably is made in the form of inclined planes situated on either side of the shaping belt. These rollers, which are mounted on transverse axles integral with the support of the plate, thus cause the support to slide vertically along said drive shafts fixed to the chains.

In a third phase, the tamping and ejecting means, which hitherto has remained in its lower position in which it keeps the individual articles on the conveyor belt, in turn ascends, disengages from the plate and is returned to its starting or waiting position in which it will be entrained by a finger integral with the support of the following plate. The individual shaped articles thus released from the cells are carried out of the apparatus on the endless conveyor belt.

The vertical and the horizontal-return movements of the tamping and ejecting means are imparted by the vertical and horizontal-return drive mechanism. This mechanism of the tamping and ejecting unit means may comprise, on the one hand, vertical drive means, such as a pneumatic piston motor, for example, connected to the vertically displaceable horizontal shaft on which the hood slides. The mechanism in question may comprise, on the other hand, horizontal drive means, such as a pneumatic piston motor, for example, intended to return or push the tamping and ejecting means sliding on the horizontal shaft back into its first, or waiting, position.

During these various movements, the pivotal, horizontal-forward drive arm integral with the hood of the tamping and ejecting unit means is either in its engaged position in which it is able to cooperate with or be pushed by the horizontal-forward drive fingers integral with the supports of the plates, or in its disengaged position in which the tamping and ejecting means can be returned or pushed back to its waiting position. The pivoting movements from one position to the other may be imparted to this arm by drive means such as a pneumatic motor, for example.

These various movements may be controlled and synchronized, for example, by pneumatic or electrical switches, depending on the type of drive means used, arranged at certain distances along the tamping and ejecting unit means and actuated by the movements of the plate supports and the tamping and ejecting means.

The invention is described hereinafter with reference to the accompanying drawings.

DETAILED DESCRIPTION OF THE DRAWINGS

Figure 1:
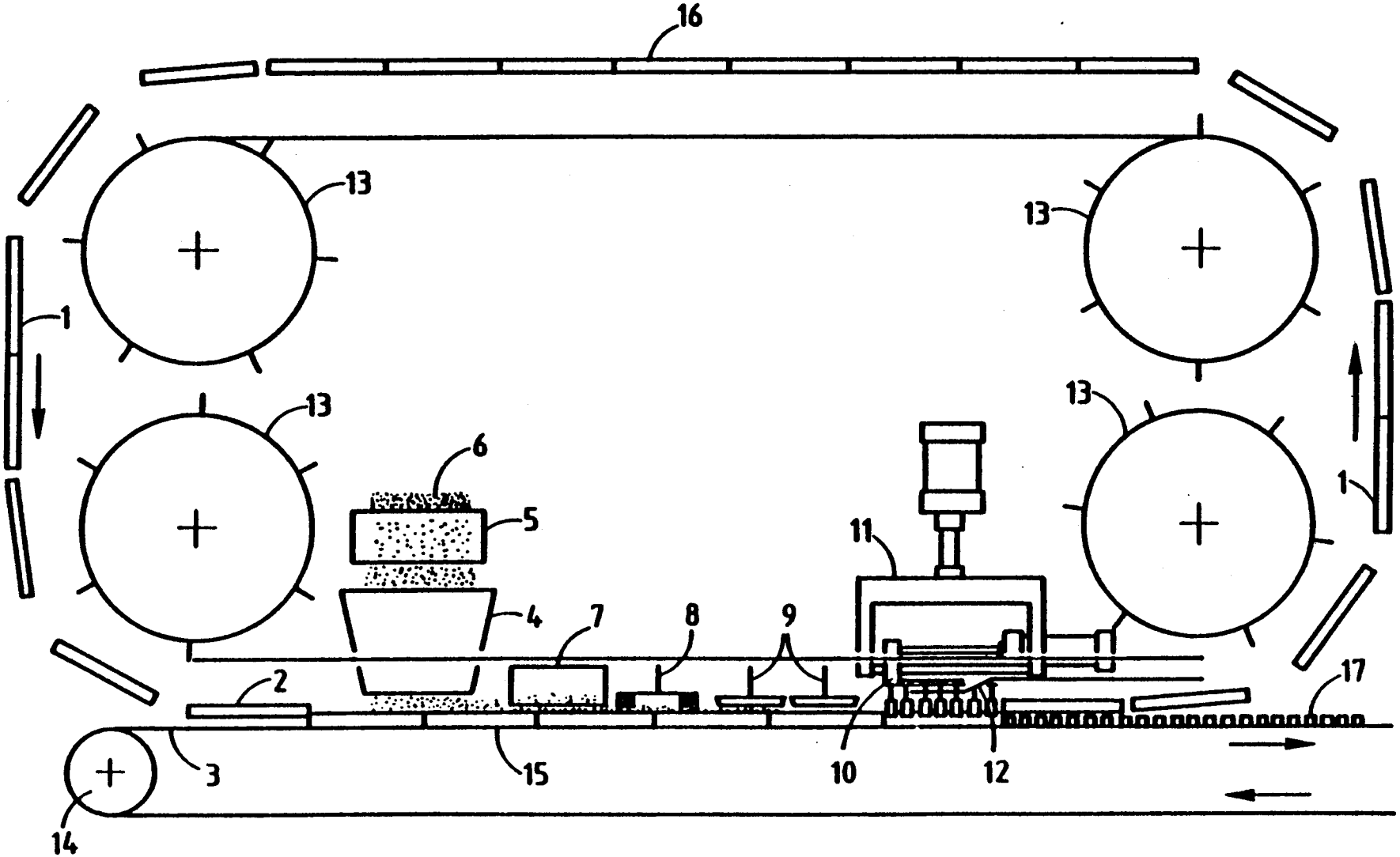
FIG. 1 is a general diagrammatic side elevation of one embodiment of the apparatus.

The embodiment of the apparatus shown in FIG. 1 comprises an endless shaping belt 1 formed by juxtaposed apertured plates 2, an endless conveyor belt 3 beneath the shaping belt 1 and forming cells with the apertures in said plates 2, means 4, 5 for feeding the cells, a distributing and equalizing unit 7, 8 and 9 and a tamping and ejecting unit means 10, 11 and 12.

The endless shaping belt 1 forms an oval loop defined by four pairs of drive wheels 13 of which at least one is driven by a motor (not shown) synchronized in its rotational speed with a drive means (not shown) of a drive roller 14 of the endless conveyor belt 3. The oval loop formed by the shaping belt has a lower flat part 15 along which the apertured plates 2 pass successively beneath the feed means 4, 5 beneath the distributing and equalizing unit 7, 8 and 9 and then beneath and through the tamping and ejecting unit means. The oval loop also has an upper flat part 16 along which the apertured plates 2 return to their starting position upstream of the feed means.

The forming surface of endless conveyor belt 3 travels at the same speed and in the same direction as the shaping belt 1 along the lower flat part 15 of the loop. This endless conveyor belt 3 extends beyond the downstream end of the lower flat part 15 of the loop so that the individual articles 17 which have been shaped directly on the forming surface can be transported without any impact or drop out of the apparatus and then, for example, through a drying apparatus.

The means for feeding the cells comprises an endless transverse conveyor belt 5 ending above a hopper 4 into which it delivers a mass of particulate product 6 to be formed. The hopper 4 is arranged above the shaping belt 1 at the upstream end of the lower flat part 15 of the loop.

The distributing and equalizing unit comprises a distributing island 7 in the form (as seen from above) of a triangle of which the apex faces upstream, rotary brushes 8 and rotary smoothing discs 9. The brushes 8, of which there are two, are arranged beside one another downstream of the island 7. The smoothing discs 9, of which there are three, are arranged in a row of one overlapping a row of two covering the entire width of the shaping belt.

The tamping and ejecting unit means comprises a tamping and ejecting means ejector 10, a vertical and horizontal-return drive mechanism 11 for the tamping and ejecting means and a vertical drive guide 12. This unit is designed to be able to impart relative movements to the apertured plates 2 and to the tamping and ejecting means so that the individual articles 17 always remain on the forming surface of conveyor belt 3 throughout the tamping and ejecting operations.

Figure 3:
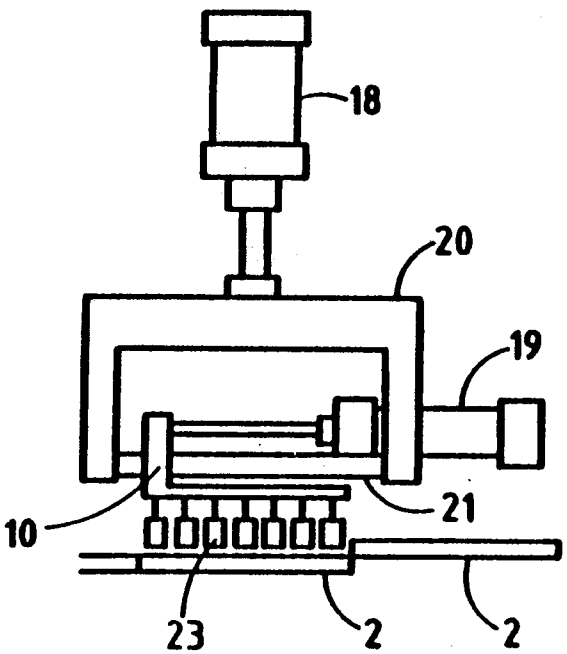
FIG. 3 is a diagrammatic side elevation of the vertical and horizontal-return drive mechanism of the ejector of the apparatus shown in FIG. 1.
Figure 2:
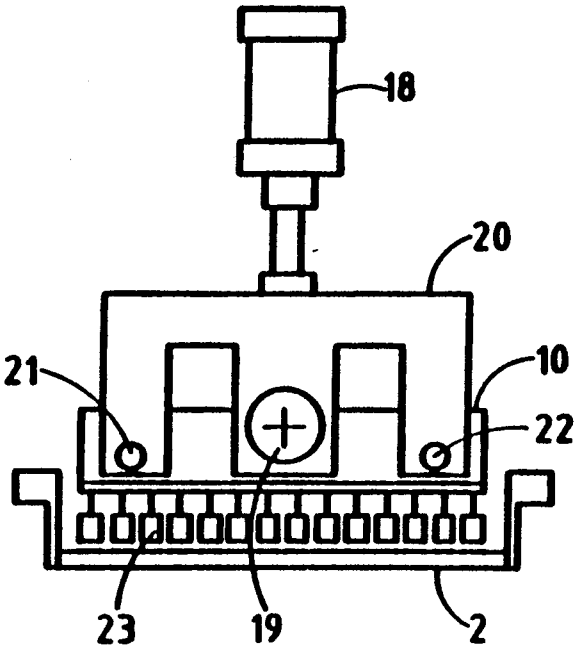
FIG. 2 is a diagrammatic front view of the vertical and horizontal-return drive mechanism of the tamping and ejecting unit means of the apparatus shown in FIG. 1.

As shown in FIGS. 2 and 3, the vertical and horizontal-return drive mechanism comprises a vertical pneumatic motor 18 and a horizontal pneumatic motor 19.

The horizontal pneumatic motor 19 and a pair of horizontal shafts 21, 22 are integral with a vertically displaceable frame 20 driven by the vertical pneumatic motor 18. The horizontal pneumatic motor 19 is intended to return or push the tamping and ejecting means sliding on the horizontal shafts 21, 22 of the tamping and ejecting unit means back into its waiting position.

The vertical pneumatic motor 18 is integral with a chassis (not shown) of the apparatus. This vertical pneumatic motor 18 is intended to make the ejector 10, of which the vertical pistons 23 are adapted to and are able to penetrate into the apertures of the apertured plates 2, descend and reascend.

Figure 4:
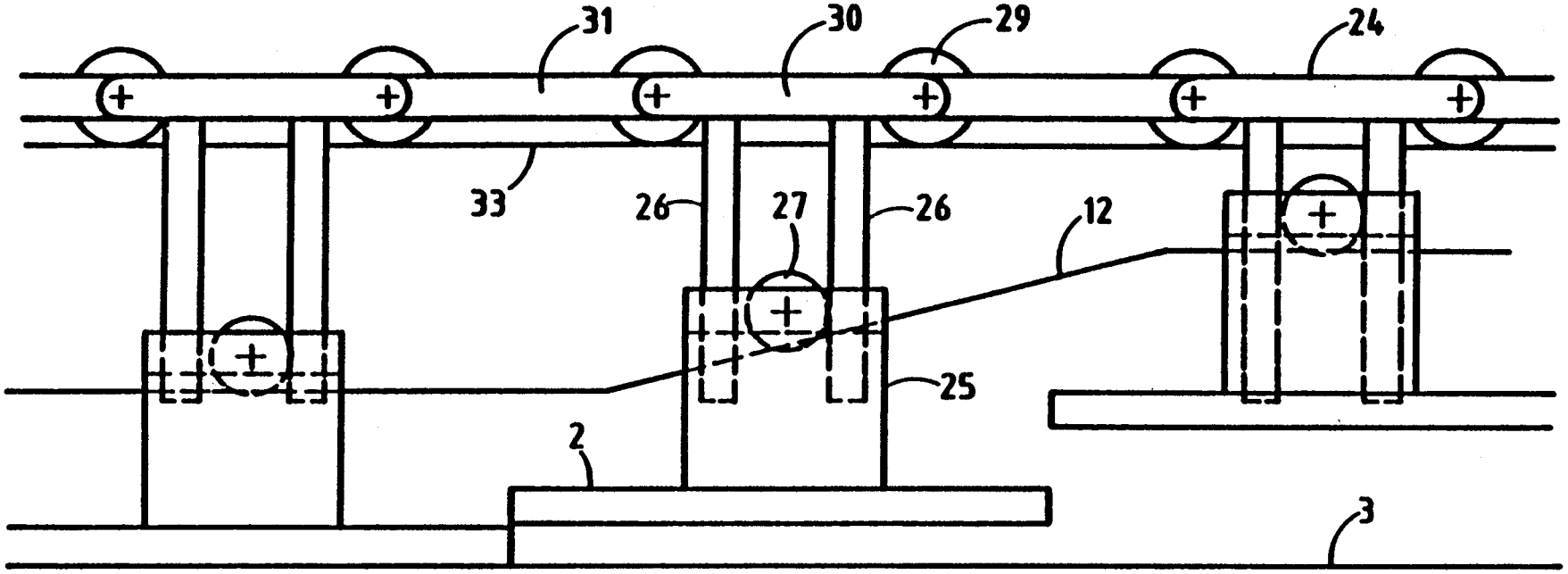
FIG. 4 is a side elevation of part of the tamping and ejecting unit means of the apparatus shown in FIG. 1.
Figure 5:
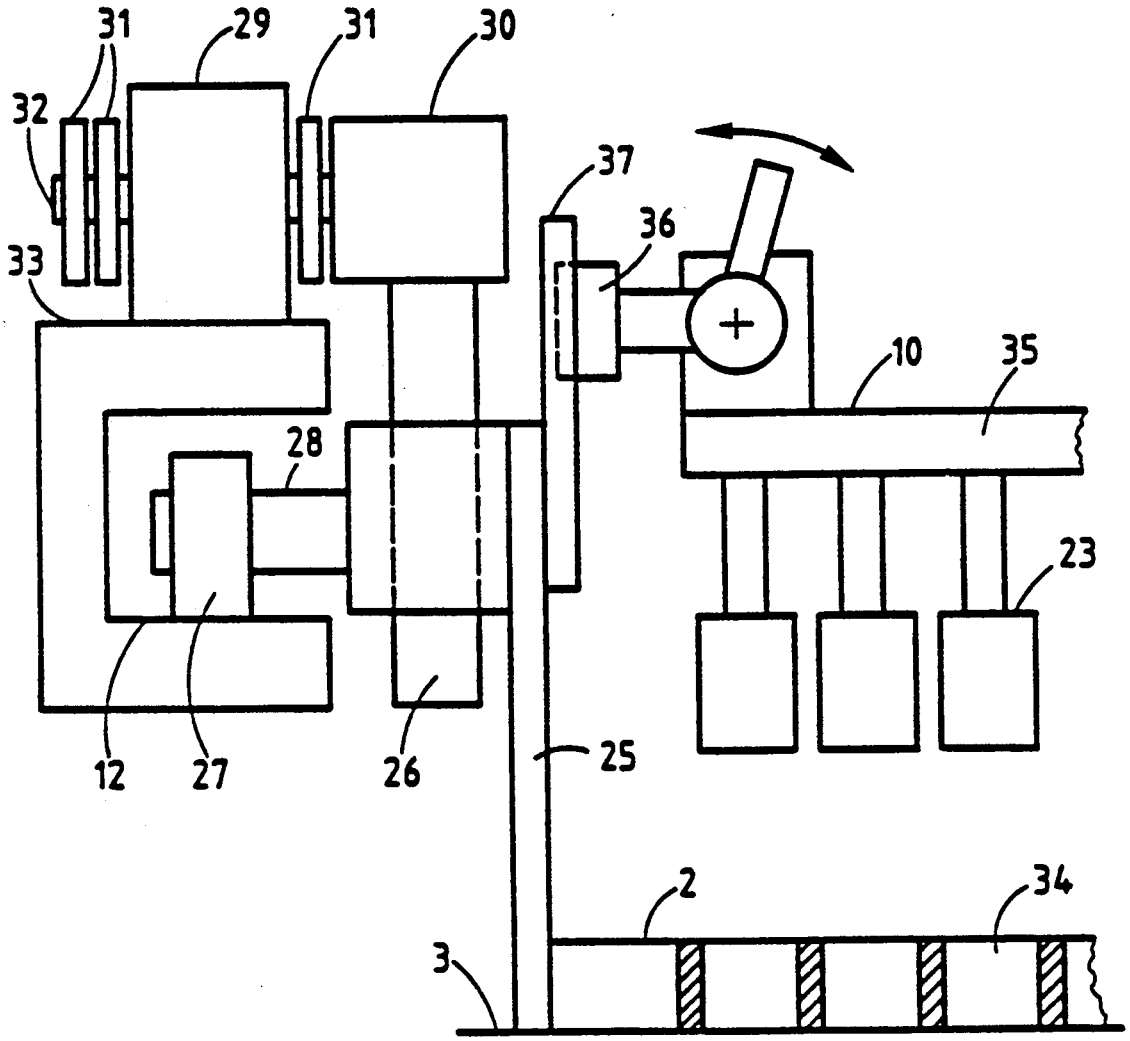
FIG. 5 is a rear view, partly in section, of another part of the tamping and ejecting unit means of the apparatus shown in FIG. 1.

As shown in FIGS. 4 and 5, the apertured plates 2, made in this case in the form of grids of the square-mesh grating type, are connected to drive chains 24 by drive supports 25 sliding on vertical drive shafts 26 fixed to the chains 24. Each plate 2 has one support at each of its two lateral ends, and at each side of the shaping belt there corresponds a drive chain 24. Each drive chain 24 comprises chain rollers 29, links 30 carrying vertical drive shafts 26 and standard links 31 fixed to the axles 32 of the chain rollers 29.

Vertical drive rollers 27 are mounted on transverse axles 28 integral with the drive supports 25. The vertical drive guide 12 is made in the form of inclined planes situated on either side of the shaping belt. The plates 2 are thus able to ascend under the effect of the vertical drive rollers 27 which engage with the vertical drive guide 12 without their horizontal movement being affected in any way. This is because the chain rollers 29 continue to run along a horizontal chain guide 33 when the supports 25 ascend, sliding on the vertical drive shafts 26.

The tamping and ejecting unit means 10, 11 and 12 comprises vertical pistons having a square horizontal section adapted to the square apertures of the plates or grids 2. The pistons 23 are thus able to penetrate into the cells 34 formed by the forming surface of endless conveyor belt 3 fastened beneath the plates or grids 2. The tamping and ejecting means comprises as many vertical pistons 23 as there are apertures or openings in each plate or grid 2. The pistons 23 are integral with a hood 35 which slides on the vertically displaceable horizontal shafts 21, 22 shown in FIGS. 2 and 3. The hood 35 additionally comprises a pivotal, horizontal-forward drive arm 36 intended to cooperate with horizontal-forward drive fingers 37 integral with the drive supports 25. The pivoting movements of this arm 36 between the engaged and disengaged positions, namely between the positions of cooperation or non-cooperation with the fingers 37, are imparted by a pneumatic motor (not shown).

Figures 6A, 6B, 6C, 6D:
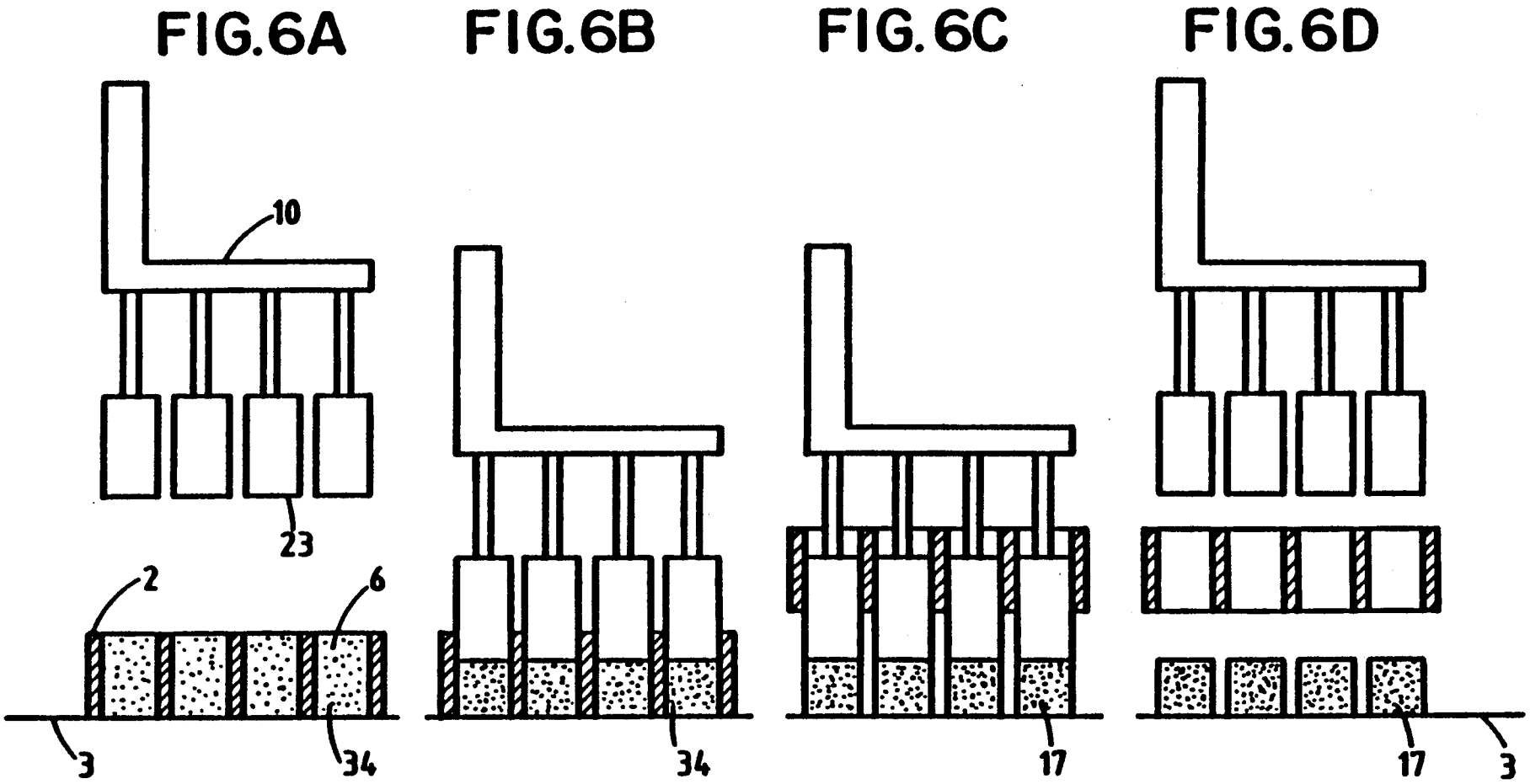
FIG. 6 diagrammatically illustrates the principle of the relative movements of the shaping plates and the tamping and ejecting means of the apparatus.

As shown in FIG. 6, the relative movements of the shaping plates 2 and the tamping and ejecting means designated by reference numeral 10 may be divided up into three main phases which are illustrated through the four relative positions A-D. In position A, the tamping and ejecting means is in its waiting position above the shaping belt at the precise moment when the drive finger integral with the drive support of the plate 2 enters into cooperation or contact with the pivotal drive arm integral with the hood of the tamping and ejecting means.

In a first phase, from position A to position B, the tamping and ejecting means descends and compresses the particulate product 6 in the cells 34 by partial penetration of the pistons 23 into the cells.

In a second phase, from position B to position C, the plate 2 ascends and disengages from the individual articles 17 while they are held on the forming surface of conveyor belt 3 by the pistons 23 which have remained in their lower position.

In a third phase, from position C to position D and back to position A, the tamping and ejecting means in turn ascends, disengages from the plate 2 and is returned to its starting or waiting position in which it will be entrained by the drive finger integral with the drive support of the following shaping plate. The shaped individual articles 17 thus released from the cells without the slightest impact are carried out of the apparatus by the endless conveyor belt which, hitherto, has served as the apron 3.

The various movements imparted by the various drive means described with reference to FIGS. 1 to 6 are actuated, controlled and synchronized by pneumatic switches arranged along the path of the tamping and ejecting means and the supports 25 of the shaping plates 2.

We claim:

1. A process for shaping particulate material into individual shaped articles comprising:

conveying plates containing apertures therethrough on a surface for forming, by reason of the plate apertures and the forming surface, article shaping cells;

feeding particulate material to be shaped to the cells;

conveying the plates containing the material on the forming surface in the cells to a tamping and ejecting means and then conveying the plates and material and the tamping and ejecting means in a downstream direction in synchronization;

tamping the material in the cells with the tamping and ejecting means while conveying the plates and the material and the tamping and ejecting means for obtaining tamped material in the cells on the forming surface;

displacing the plates away from the forming surface while conveying the plates and tamped material and the tamping and ejecting means and while maintaining the tamped material in contact with the forming surface with the tamping and ejecting means thereby ejecting the tamped material from the plates and providing individual shaped articles of material on the forming surface; and then disengaging the tamping and ejecting means from the plates and returning the tamping and ejecting means upstream to be conveyed downstream again in synchronization with the plates and material for tamping and ejecting material.

2. A process according to claim 1 further comprising conveying the forming surface in the downstream direction in synchronization with the movement of the plates.

3. A process according to claim 1 or 2 wherein the tamping and ejecting means includes pistons for first tamping the material in the cells and then for ejecting the material from the plates.

4. A process according to claim 1 or 2 further comprising conveying the ejected shaped articles of material on the forming surface to a dryer and then drying the shaped articles of material.

5. A process according to claim 1 or 2 further comprising distributing and equalizing material fed to the cells for filling the cells with material to be shaped prior to tamping the material.

6. A process according to claim 1 or 2 wherein the forming surface is substantially horizontal and the tamping and ejecting means is disengaged from the plates by ascending the tamping and ejecting means from the plates.

7. A process according to claim 1 or 2 wherein the plates are juxtaposed and endlessly conveyed and wherein the forming surface is an endless conveyor belt.

8. A process for shaping particulate material into individual shaped articles comprising:

conveying juxtaposed plates containing apertures therethrough on and in synchronization with a substantially horizontal surface for forming, by reason of the plate apertures and the substantially horizontal forming surface, article shaping cells;

feeding particulate material to be shaped to the cells;

conveying the forming surface and the plates containing the material in the cells on the forming surface to a tamping and ejecting means and then conveying the plates and material, the forming surface and the tamping and ejecting means in a downstream direction in synchronization;

tamping the material in the cells with the tamping and ejecting means while conveying the plates and the material, the forming surface and the tamping and ejecting means for obtaining tamped material in the cells on the forming surface; and then displacing the plates away from the forming surface while conveying the plates and tamped material, the forming surface and the tamping and ejecting means and while maintaining the tamped material in contact with the forming surface with the tamping and ejecting means thereby ejecting the tamped material from the plates and providing individual shaped articles of material on the forming surface; and then disengaging the tamping and ejecting means from the plates and returning the tamping and ejecting means upstream to be conveyed again downstream in synchronization with the forming surface and the plates and material for tamping and ejecting material.

9. A process according to claim 8 wherein the tamping and ejecting means includes pistons for first tamping the material in the cells and then for ejecting the material from the plates.

10. A process according to claim 8 further comprising conveying the ejected shaped articles of material on the forming surface to a dryer and then drying the shaped articles of material.

11. A process according to claim 8 further comprising distributing and equalizing material fed to the cells for filling the cells with material to be shaped prior to tamping the material.

12. A process according to claim 8 wherein the tamping and ejecting means is disengaged from the plates by ascending it from the plates.

13. A process according to claim 8 wherein the plates are endlessly conveyed and wherein the forming surface is an endless conveyor belt.

* * * * *